US006948380B1

(12) United States Patent
Shiao et al.

(10) Patent No.: US 6,948,380 B1
(45) Date of Patent: Sep. 27, 2005

(54) TORQUE-INDICATING WRENCH

(75) Inventors: Hsuan-Sen Shiao, Taichung Hsien (TW); Da-Jeng Yao, Hsin Tien (TW); Tsong-Li Lee, Nan Tou Hsien (TW); Chia-Ju Wu, Tou Liu (TW); Han-Tai Fan, Nan Tou (TW)

(73) Assignee: Stand Tools Enterprise Co., Ltd., Taichung (TW)

( * ) Notice: Subject to any disclaimer, the term of this patent is extended or adjusted under 35 U.S.C. 154(b) by 0 days.

(21) Appl. No.: 10/989,452

(22) Filed: Nov. 16, 2004

(30) Foreign Application Priority Data

Aug. 23, 2004 (TW) ..... 09312534

(51) Int. Cl.[7] ..... B25B 23/14
(52) U.S. Cl. ..... 73/862.21
(58) Field of Search ..... 73/862, 862.21, 73/862.08, 862.181, 862.22, 862.23, 862.338, 73/862.331

(56) References Cited

U.S. PATENT DOCUMENTS 3,970,155 A * 7/1976 Otto ..... 73/862.26
4,006,629 A * 2/1977 Barrett et al. ..... 73/862.26
4,522,075 A * 6/1985 Pohl ..... 73/862.23
4,669,319 A * 6/1987 Heyraud ..... 73/862.23
4,976,133 A * 12/1990 Pohl ..... 73/862.08
6,463,811 B1 * 10/2002 Putney ..... 73/862.21
6,784,799 B2 * 8/2004 Hsien ..... 73/862.23

* cited by examiner

*Primary Examiner*—Edward Lefkowitz
*Assistant Examiner*—T Miller
(74) *Attorney, Agent, or Firm*—Ladas & Parry LLP

(57) ABSTRACT

A torque-indicating wrench includes a wrench body with a head to engage and turn a workpiece, and a stem having an inner peripheral wall with longitudinal and transverse wall segments. A strainable body made of a material with an elasticity modulus smaller than that of the stem has an outer peripheral wall which includes front and rear bending force transmitting areas in engagement with and stretchable relative to the front and rear regions of the longitudinal wall segments, and two gage carrying regions and front and rear end regions that are spaced apart from the longitudinal and transverse wall segments, respectively. A strain gage unit is attached to one of the gage carrying regions to detect change in resistance values corresponding to stretching deformation of the strainable body for processing by a processing circuit so as to obtain a value of torque applied to the workpiece.

6 Claims, 12 Drawing Sheets

TORQUE-INDICATING WRENCH

CROSS-REFERENCE TO RELATED APPLICATION

This application claims priority of Taiwanese Application No. 093125346, filed on Aug. 23, 2004.

BACKGROUND OF THE INVENTION

1. Field of the Invention

This invention relates to a torque-indicating wrench, more particularly to an electrical torque-indicating wrench with a replaceable strain gage unit mounted to a wrench body for measuring a torque applied to a workpiece with a high degree of precision.

2. Description of the Related Art

U.S. Pat. Nos. 3,970,155, 4,006,629, 4,522,075, 4,669,319 and 4,976,133 disclose electrical torque-indicating wrenches that generally have strain gages attached to a lever arm proximate to a head for measuring torque. The head is suited to engage and rotate a workpiece by applying a force to the lever arm. The strain gages detect elastic strains and changes in electrical resistances, translate the changes into an electrical signal, and, in cooperation with a processing circuit which includes a Wheatstone bridge, an amplifier, a recorder, a microprocessor, an output unit, etc., determine a value of torque applied to the workpiece. Strain ($\epsilon$) is related to a bending moment (M) through the relationship:

$$\varepsilon = \frac{M * y}{E * I}$$

When an object with a modulus of elasticity (E) and a moment of inertia (I) relative to a neutral axis is subjected to a bending moment (M), the strain ($\epsilon$) is directly proportional to a distance (y) between the measured point and the neutral axis. In the aforementioned prior art wrenches, the strain gages are attached to a lateral surface of the lever arm away from the neutral axis so as to produce a larger strain value, based upon which the processing circuit can calculate the torque precisely. However, a relatively large area of the lateral surface of the lever arm to which the strain gages are attached has to be machined with high precision so as to facilitate attachment of the strain gages, thereby resulting in higher manufacturing cost. Furthermore, conventional strain gages are not replaceable once they are broken or damaged.

Referring to FIGS. 1 and 2, a conventional electrical torque-indicating wrench is shown to include a wrench body 1 having a head 102 and a handle 101 extending from the head 102. The handle 101 and the head 102 respectively have first and second mounting slots 1011, 1021 for receiving a strain detecting unit 2 and a display unit 3. The strain detecting unit 2 has a substrate 201 with a profile the same as that of the first mounting slot 1011. The substrate 201 has a recess 2011 for receiving a strain gage 202. When a torque producing force is applied to the handle 101, stretching deformation of the strain gage 202 results in a change in electrical resistance, which is detected and translated into an electrical signal. The strain detecting unit 2 can be replaced once the strain gage 202 is broken. However, since the profile of the substrate 201 has to be same as that of the first mounting slot 1011, the strain gage 202 is placed in close proximity to the neutral axis (X), thereby reducing the distance (y). Therefore, the strain ($\epsilon$) in the strain gage 202 is relatively small so that the change in electrical resistance is too small to permit precise torque measurement. Furthermore, although a signal output corresponding to the change in resistance can be amplified by amplifiers, the errors in the signal will be amplified at the same time so that a precise torque value cannot be obtained.

SUMMARY OF THE INVENTION

The object of the present invention is to provide a torque-indicating wrench which has a replaceable strain gage unit mounted to a wrench body for measuring a torque applied to a workpiece with a high degree of precision.

According to this invention, the torque-indicating wrench includes a wrench body having a head adapted to engage and turn a workpiece about a rotational axis, and a stem extending from the head in a longitudinal direction radial to the rotational axis. The stem terminates at a coupled end, and is made from a material with a first modulus of elasticity. The stem has an inner peripheral wall to define a mounting slot. The inner peripheral wall includes two longitudinal wall segments opposite to each other relative to a neutral line in the longitudinal direction, and front and rear transverse wall segments spaced apart from each other in the longitudinal direction to define the mounting slot. Each of the longitudinal wall segments includes front and rear regions proximate to the front and rear transverse wall segments, respectively, and a middle region interposed therebetween.

A handle is disposed to couple with the coupled end and is operable to turn the head about the rotational axis.

A strainable body made from a material with a second modulus of elasticity that is smaller than the first modulus of elasticity has an outer peripheral wall insertable into the mounting slot so as to place the strainable body in a position of use where the strainable body is subject to stretching in the longitudinal direction in response to turning movement of the handle about the rotational axis. The outer peripheral wall includes a pair of front bending force transmitting areas and a pair of rear bending force transmitting areas opposite to each other in the longitudinal direction, respectively. Each front bending force transmitting area and each rear bending force transmitting area, in the position of use, are respectively brought into engagement with and are stretchable relative to the corresponding front region and the corresponding rear regions, respectively. The outer peripheral wall further includes a pair of gage carrying regions which are opposite to each other relative to the neutral line, and each of which is interposed between the respective front bending force transmitting area and the respective rear bending force transmitting area, and front and rear end regions which, in the position of use, are spaced apart from the front and rear transverse wall segments, respectively, so as to accommodate stretching movement of the strainable body.

A strain gage unit is attached to at least one of the gage carrying regions, and confronts the middle region of the corresponding longitudinal wall segment to detect change in resistance values which is a function of extent of stretching deformation of the strainable body as a result of application of torque by the head when the head turns the workpiece about the rotational axis, and to translate the change in resistance values into an electrical signal.

A processing circuit is connected electrically to the strain gage unit, and calculates a value of the torque applied to the workpiece in accordance with the electrical signal from the strain gage unit so as to generate an output signal.

A display unit is connected electrically to the processing circuit for receiving the output signal from the processing circuit and translating the output signal into a visual presentation.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
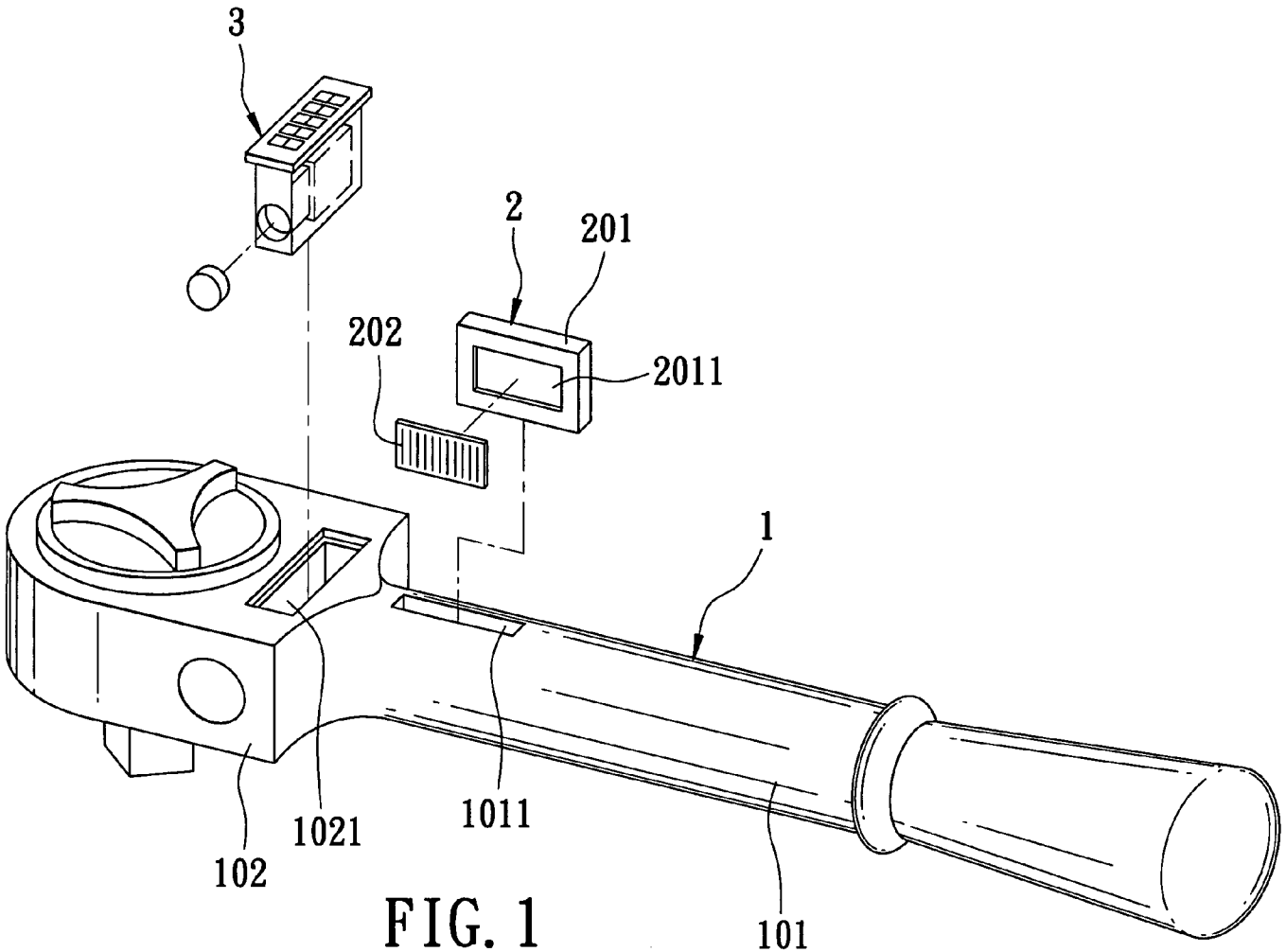
FIG. 1 PRIOR ART
FIG. 1 is an exploded perspective view of a conventional electrical torque-indicating wrench.

Before the present invention is described in greater detail, it should be noted that same reference numerals have been used to denote like elements throughout the specification.

Referring to FIGS. 3 to 6, the first preferred embodiment of a torque-indicating wrench according to the present invention is shown to comprise a wrench body 10, a handle 50, a strain detecting unit 20, a processing circuit 30, and a display unit 40.

Figure 7:
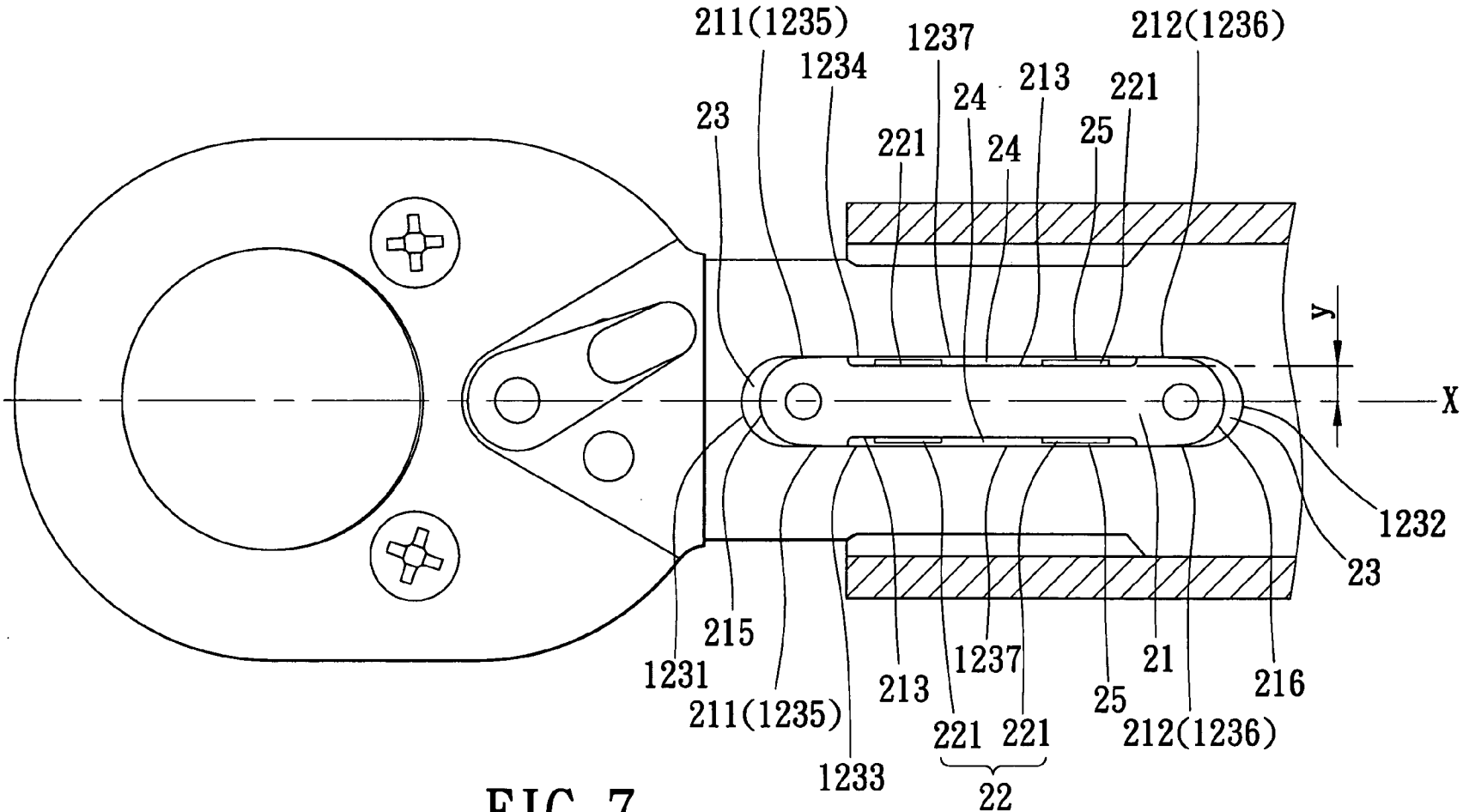
FIG. 7 is a fragmentary, partly sectional view of the first preferred embodiment.
Figure 8:
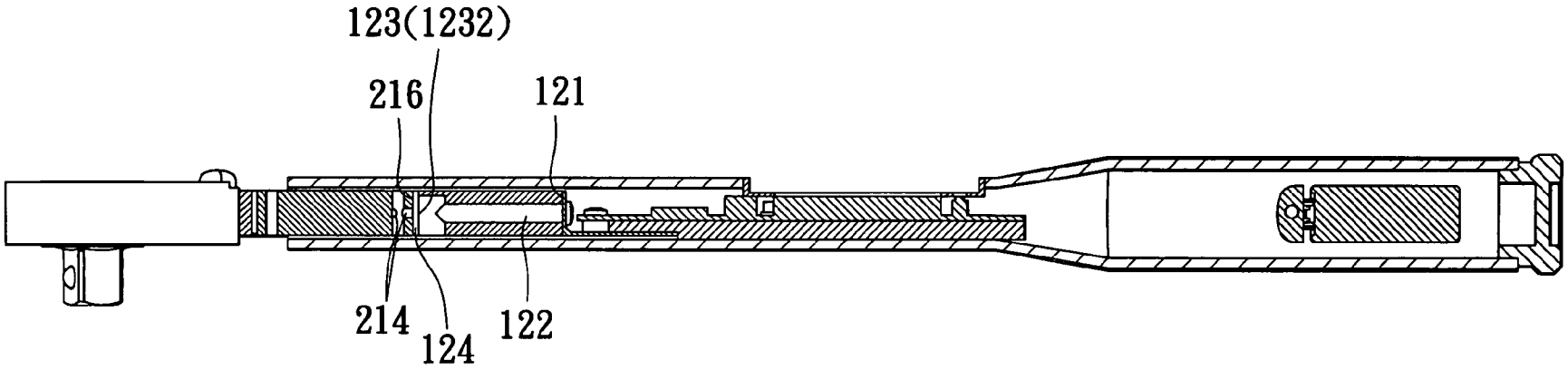
FIG. 8 is a sectional view of first preferred embodiment but taken from another angle.
Figure 9:
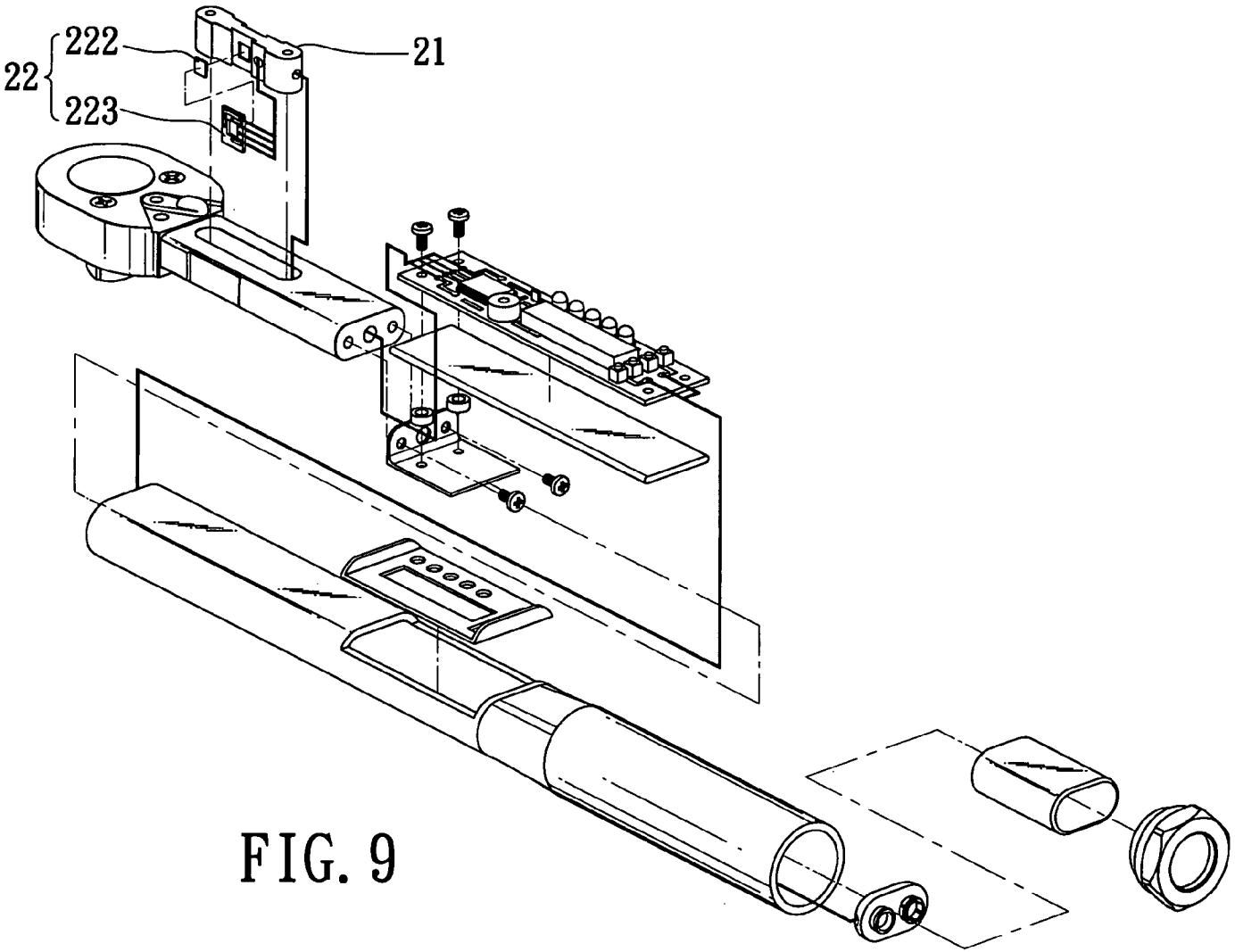
FIG. 9 is an exploded perspective view of the second preferred embodiment of a torque-indicating wrench according to this invention.
Figure 10:
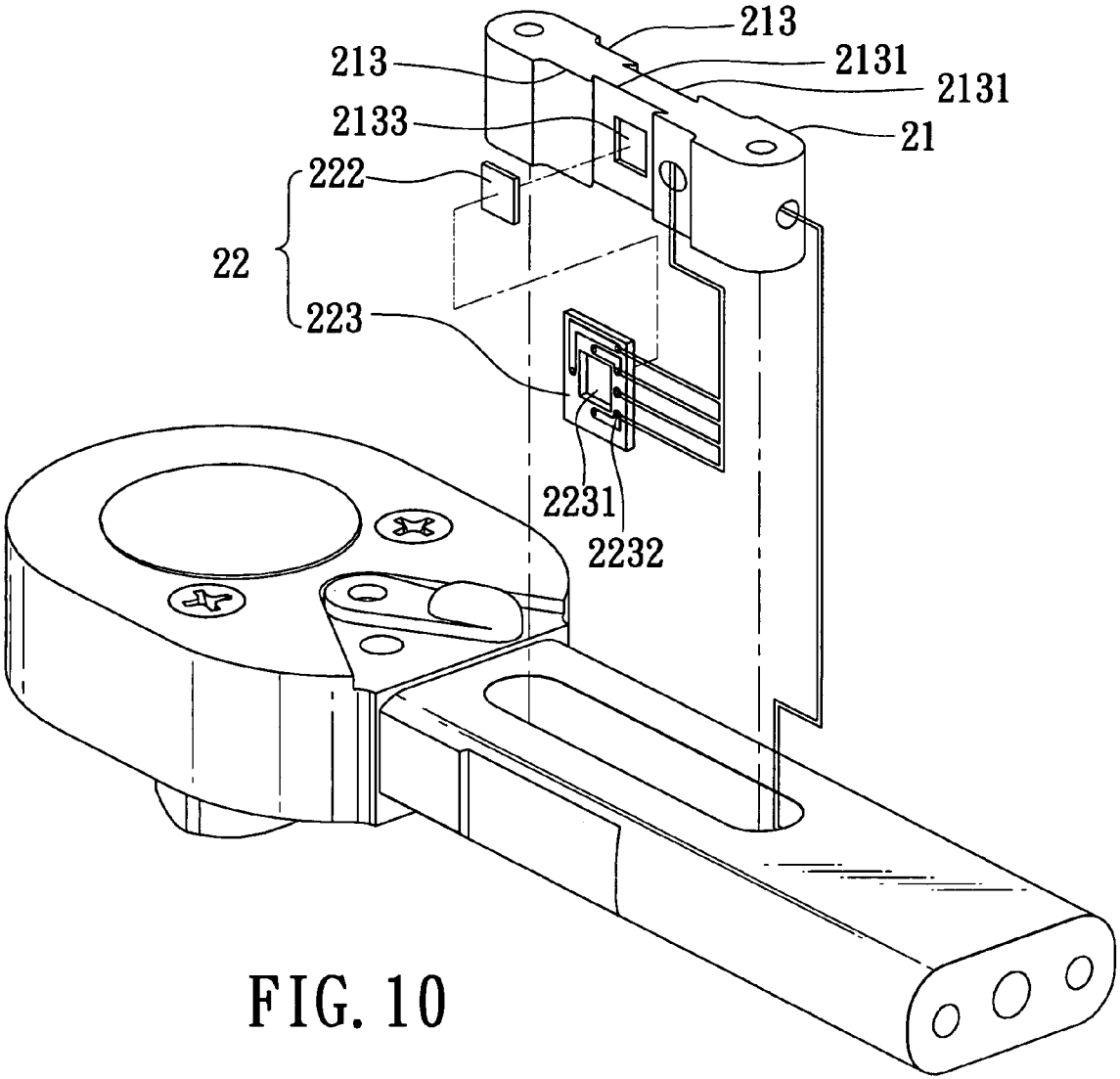
FIG. 10 is an exploded perspective view of a wrench body and a strain detecting unit of the second preferred embodiment.
Figure 11:
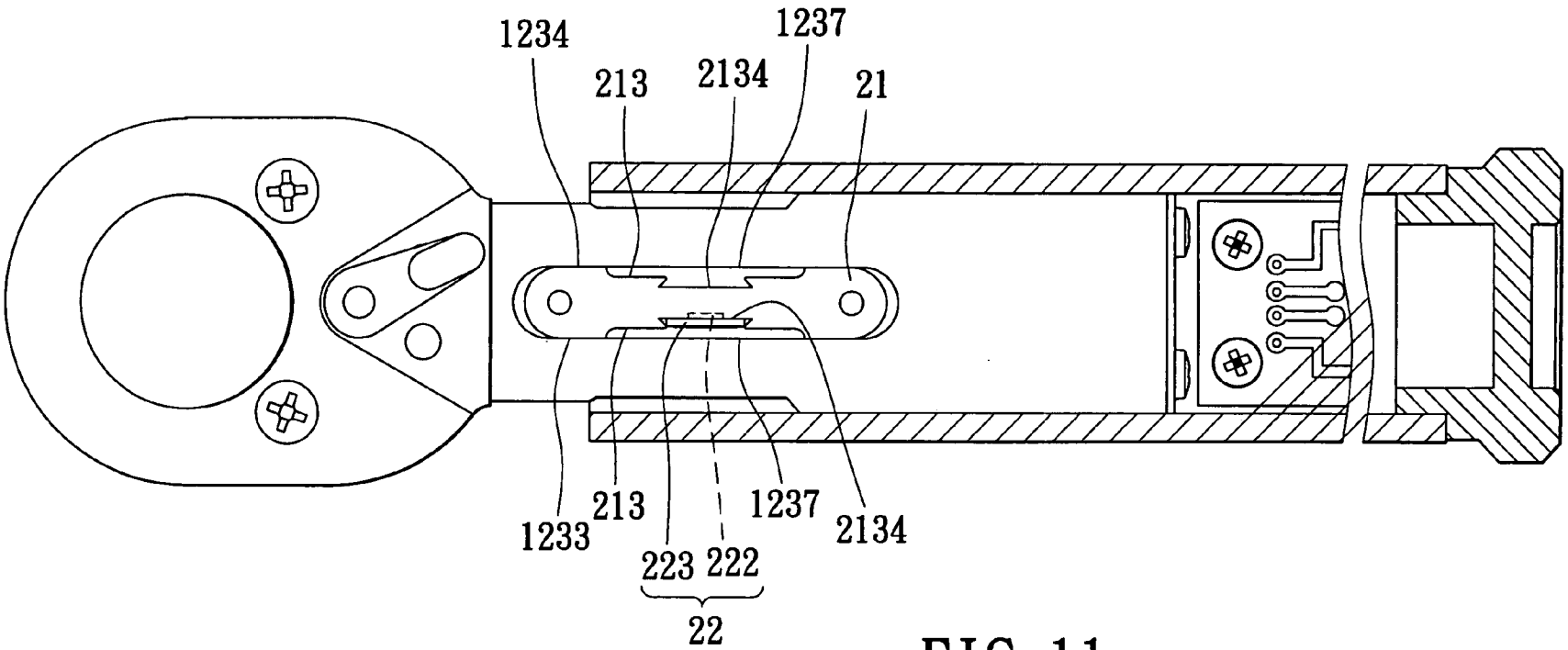
FIG. 11 is a fragmentary, partly sectional view of the second preferred embodiment.
Figure 12:
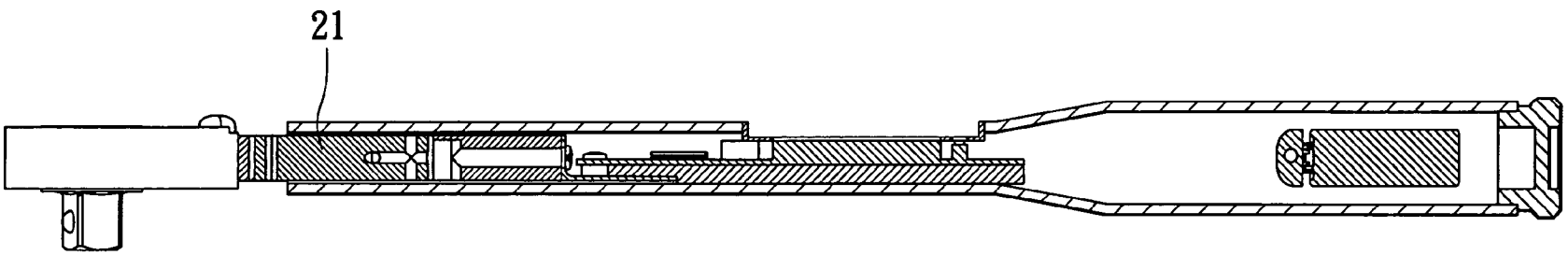
FIG. 12 is a sectional view of the second preferred embodiment.

The wrench body 10 has a head 11 which is adapted to engage and turn a workpiece (not shown) about a rotational axis, and a stem 12 which extends from the head 11 in a longitudinal direction radial to the rotational axis, and which terminates at a coupled end 121. The stem 12 is made from a material with a first modulus of elasticity (E1), such as steel with E1=190 Gpa, and has an inner peripheral wall 123 to define a mounting slot 124. With further reference to FIG. 7, the inner peripheral wall 123 includes two longitudinal wall segments 1233, 1234 which are opposite to each other relative to a neutral line (X) in the longitudinal direction, and front and rear transverse wall segments 1231, 1232 which are spaced apart from each other in the longitudinal direction, and which cooperate with the longitudinal wall segments 1233, 1234 to define the mounting slot 124. In addition, each of the longitudinal wall segments 1233, 1234 includes front and rear regions 1235, 1236 which are proximate to the front and rear transverse wall segments 1231, 1232, respectively, and a middle region 1237 which is interposed therebetween. The coupled end 121 defines a wire receiving hole 122 that extends to be communicated with the mounting slot 124, as shown in FIG. 8.

The handle 50 is tubular, and has a front portion 51 which defines a forwardly opened recess that extends in the longitudinal direction and that is configured for insertion of the stem 12 in the longitudinal direction so as to be operable to turn the head 11 about the rotational axis, and a rear portion 52 which is opposite to the front portion 51, and which has a display opening 53.

The strain detecting unit 20 is detachably mounted in the mounting slot 124, and includes a strainable body 21 and a strain gage unit 22.

The strainable body 21 is made from a material with a second modulus of elasticity (E2) that is smaller than the first modulus of elasticity (E1), such as aluminum alloy with E2=70 Gpa, and has an outer peripheral wall which is configured to be insertable into the mounting slot 124 so as to place the strainable body 21 in a position of use where the strainable body 21 is subject to stretching in the longitudinal direction in response to turning movement of the handle 11 about the rotational axis.

As shown in FIG. 7, the outer peripheral wall of the strainable body 21 includes a pair of front bending force transmitting areas 211 which are opposite to each other relative to the neutral line (X), and a pair of rear bending force transmitting areas 212 which are opposite to each other relative to the neural line (X). Each of the rear bending force transmitting areas 212 is opposite to the respective front bending force transmitting area 211 in the longitudinal direction. Each of the front bending force transmitting areas 211 and each of the rear bending force transmitting areas 212, in the position of use, are respectively brought into engagement with and are respectively stretchable relative to the corresponding front region 1235 and the corresponding rear region 1236. The outer peripheral wall further includes a pair of gage carrying regions 213 which are opposite to each other relative to the neutral line (X), and each of which is interposed between the respective front bending force transmitting area 211 and the respective rear bending force transmitting area 212, and front and rear end regions 215, 216 which are opposite to each other in the longitudinal direction, and which, in the position of use, are configured to be spaced apart from the front and rear transverse wall segments 1231, 1232 by clearances 23, respectively, so as to accommodate the stretching movement of the strainable body 21. Each of the gage carrying regions 213 defines a wire guiding hole 214 that extends to be communicated with the wire receiving hole 122 in the stem 12, and, in the position of use, is spaced apart from the middle region 1237 of the corresponding longitudinal wall segment 1233, 1234 by a clearance 24.

The strain gage unit 22 includes two pairs of the strain gages 221 attached to the gage carrying regions 213, respectively. The strain gages 221 of each pair are spaced apart from each other in the longitudinal direction, and confront and are spaced apart from the middle region 1237 of the corresponding longitudinal wall segment 1233, 1234 by a clearance 25 for accommodating a deformation movement of the strainable body 21, which is effected along a direction transverse to the longitudinal direction and the rotational axis, and which is brought about as a result of the stretching deformation of the strainable body 21. Each of the strain gages 221 detects a change in resistance values, which is a function of extent of stretching deformation of the strainable body 21 as a result of application of torque by the head 11 when the head 11 turns the workpiece about the rotational axis, and translates the change in resistance values into an electrical signal.

The processing circuit 30 is mounted on the stem 12, and is connected electrically to the strain gages 221 by electric wires 60 that extend through the wire guiding holes 214 and the wire receiving hole 122. The processing circuit 30 calculates a value of the torque applied to the workpiece in accordance with the electrical signal received from the strain gage unit 22 so as to generate an output signal.

Figure 2:
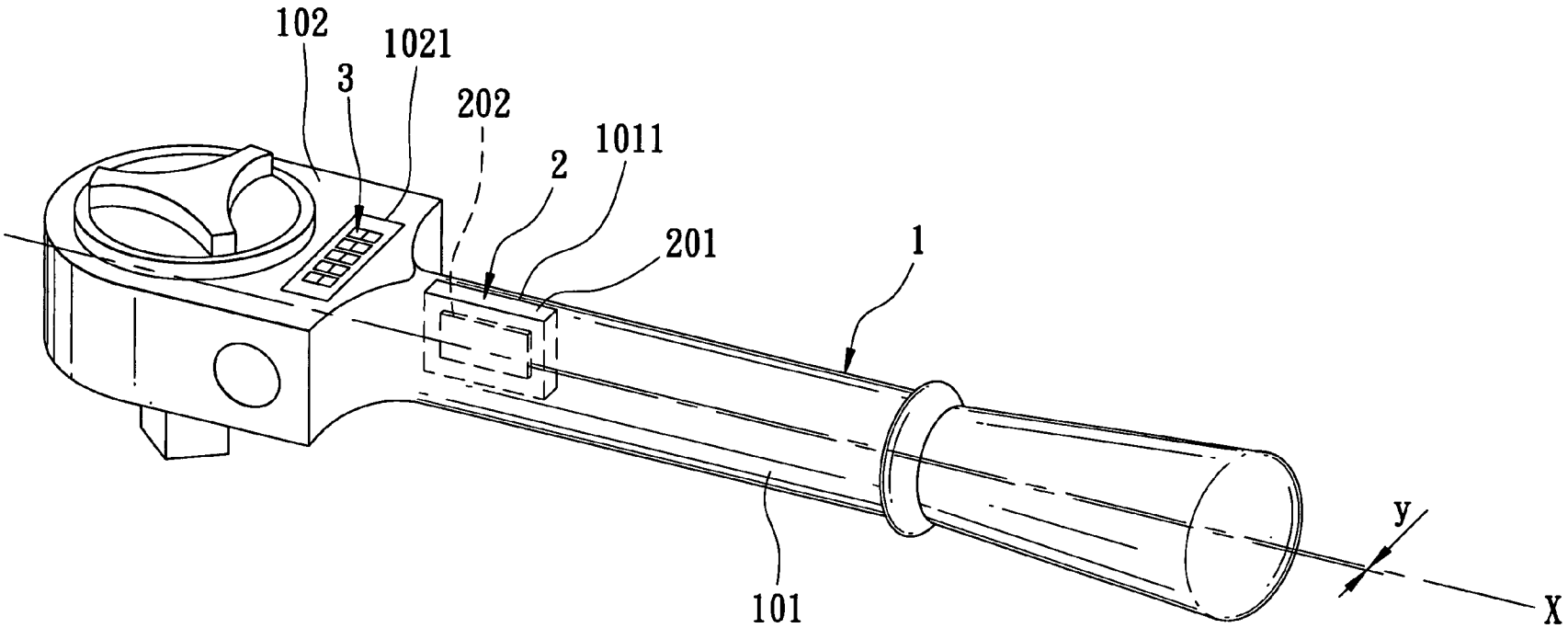
FIG. 2 PRIOR ART
FIG. 2 is a perspective view of the conventional electrical torque-indicating wrench.
Figure 3:
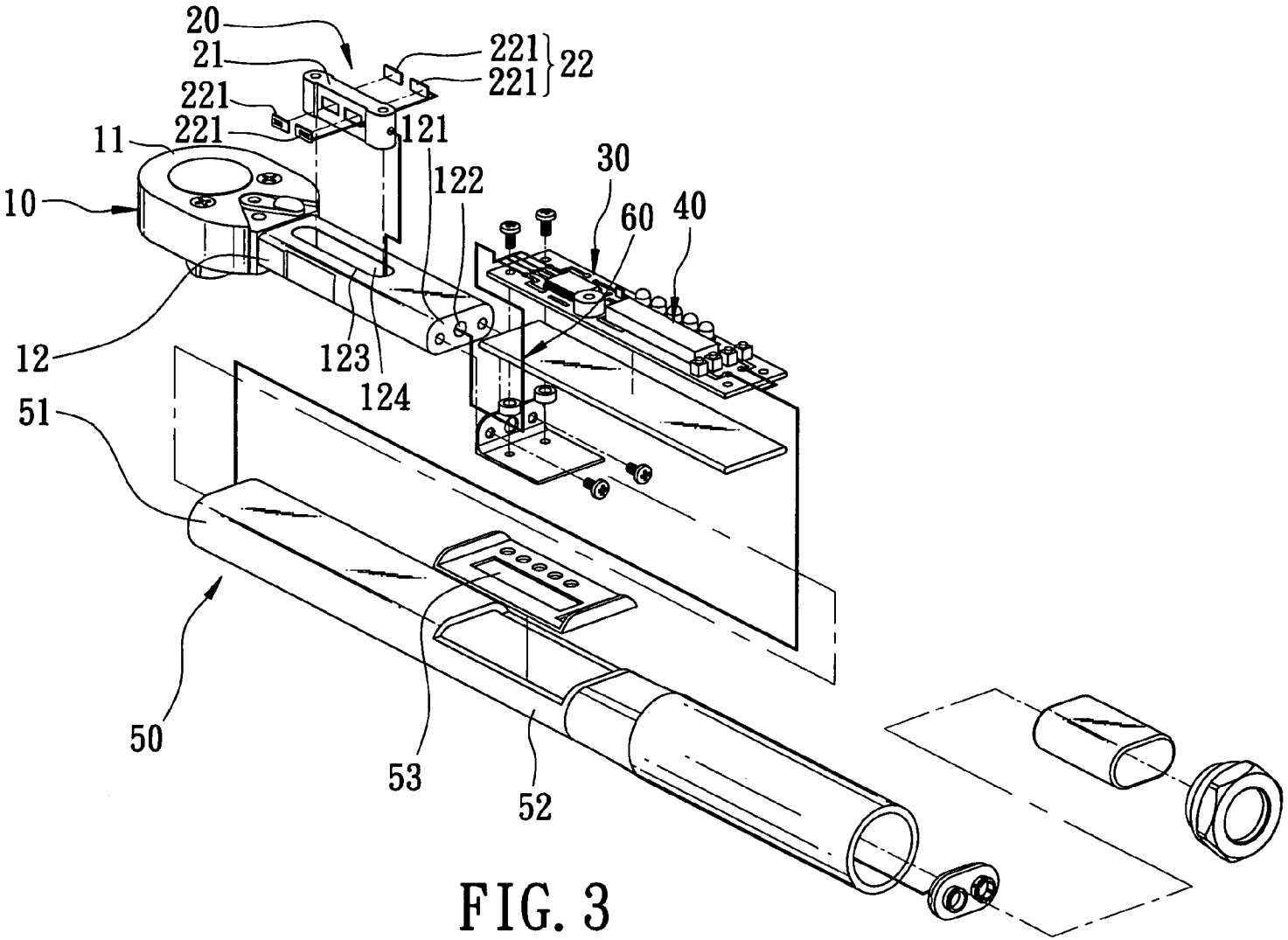
FIG. 3 is an exploded perspective view of the first preferred embodiment of a torque-indicating wrench according to this invention.
Figure 4:
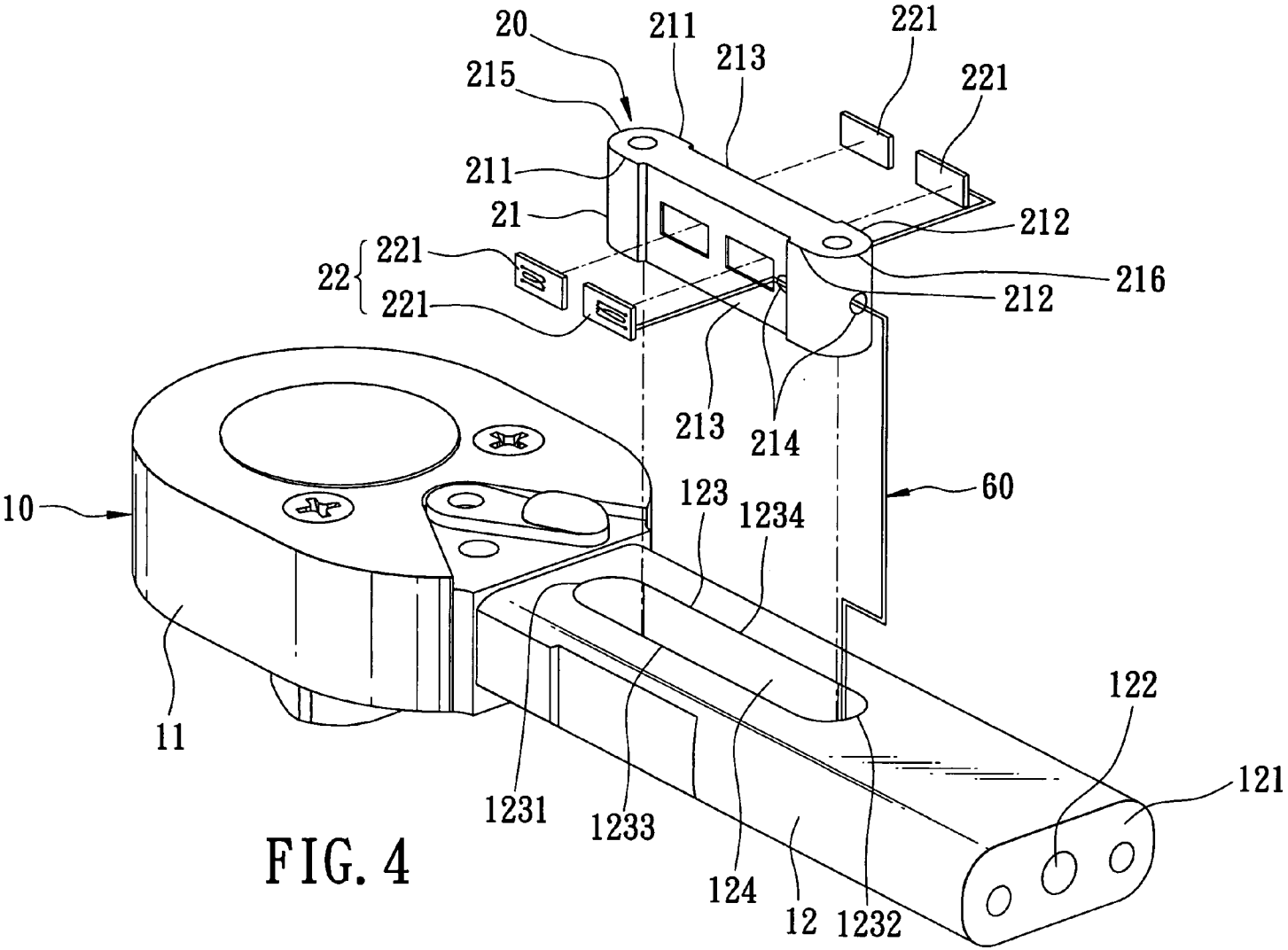
FIG. 4 is an exploded perspective view of a wrench body and a strain detecting unit of the first preferred embodiment.
Figure 5:
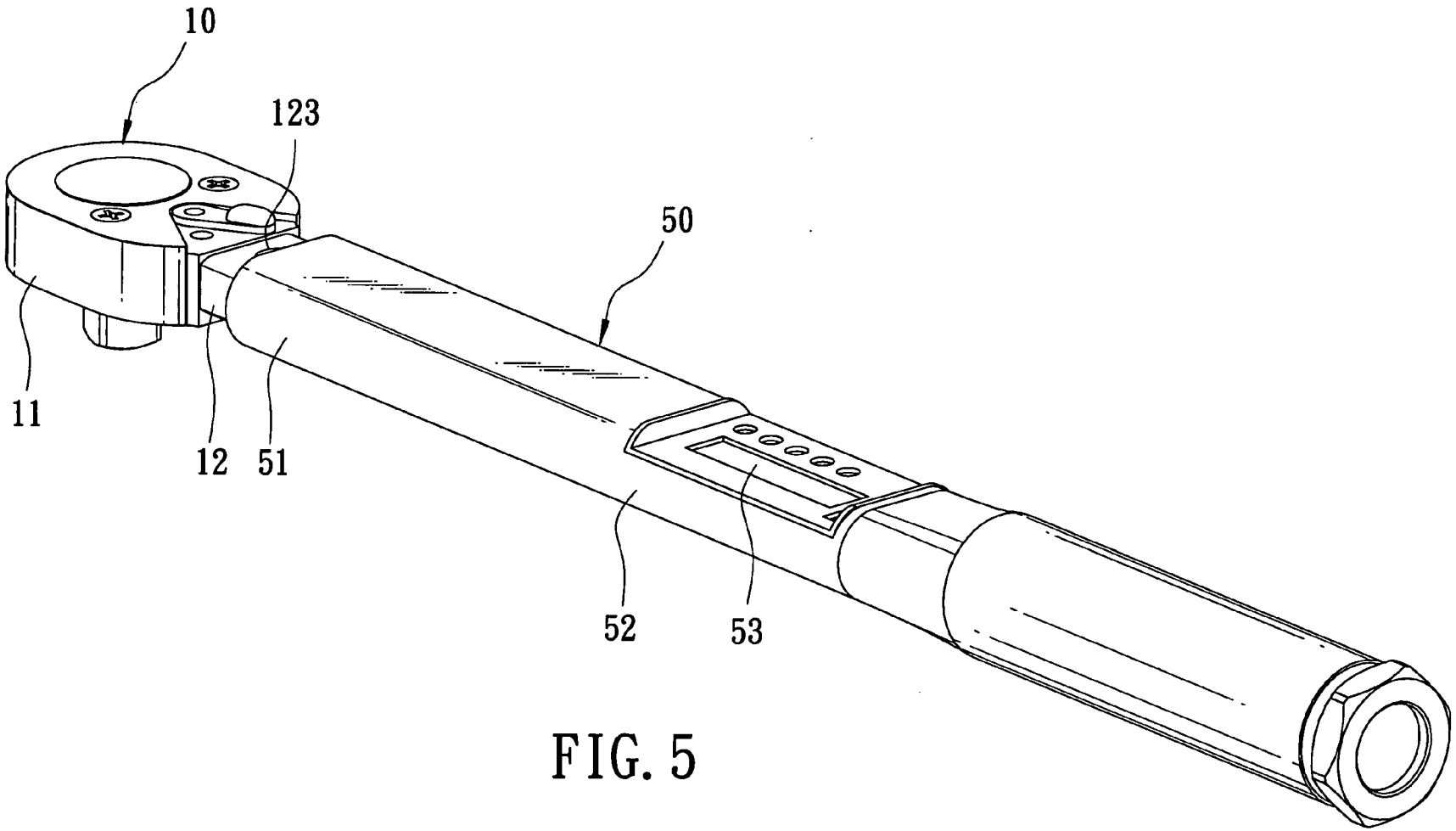
FIG. 5 is a perspective view of the first preferred embodiment.
Figure 6:
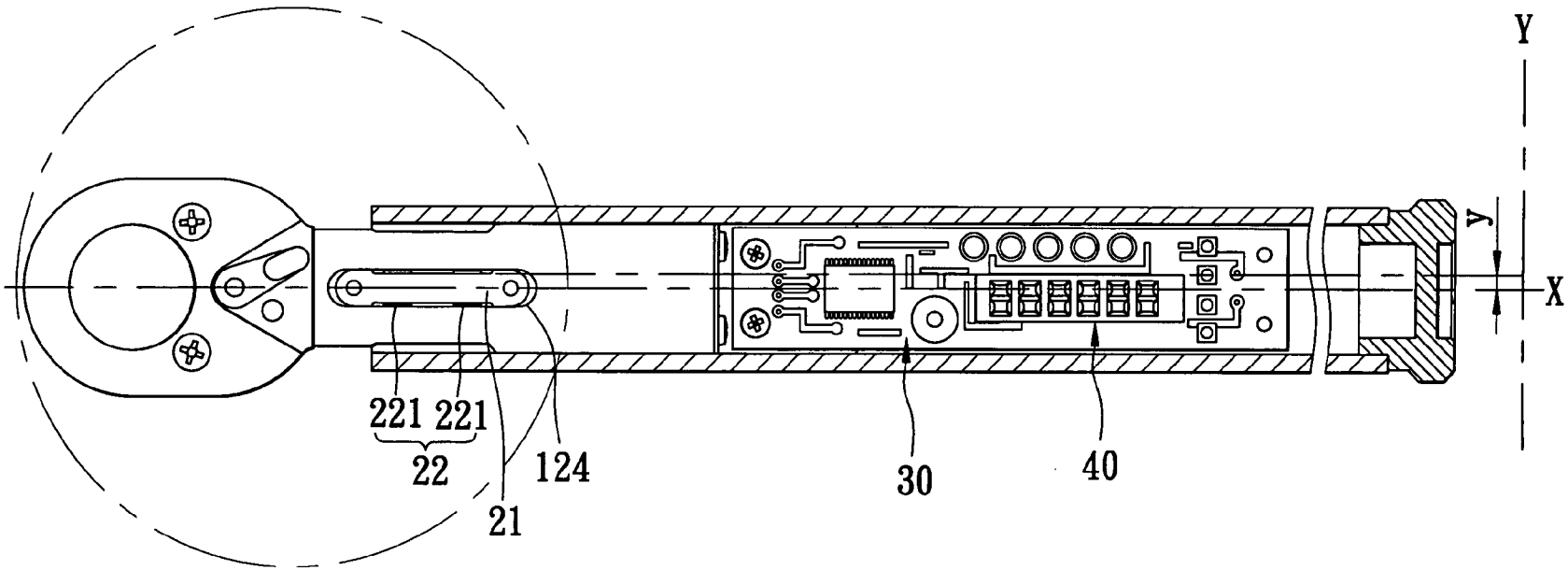
FIG. 6 is a sectional view of the first preferred embodiment.

The display unit 40 is received in the rear portion 52 of the handle 50, and is connected electrically to the processing circuit 30 for receiving the output signal from the processing circuit 30 and translating the output signal into a visual presentation for viewing through the display opening 53. As the processing circuit 30 and the display unit 40 are known in the art, a detailed description thereof is dispensed with herein for the sake of brevity. Referring to FIGS. 6 and 7, when a torque is applied to the head 11 to turn a workpiece about the rotational axis, the torque producing force is transmitted to the strainable body 21 by virtue of engagement of the front and rear regions 1235, 1236 with the front and rear bending force transmitting areas 211, 212 SO as to result in stretching deformation of the strainable body 21. Due to the presence of the clearances 23, 24, 25, the deformation movement of the strainable body 21 is not interfered by the inner peripheral wall 123 of the stem 12 so that a precise torque measurement can be obtained. Moreover, since the strain gages 221 are attached to the strainable body 21, the strain detecting unit 2 can be detached from the mounting slot 124 for replacement once the strain gages 221 are broken. In addition, as compared with the aforesaid conventional electric torque-indicating wrench shown in FIGS. 1 and 2, the machining process of the strainable body 21 is easier, and can achieve a higher degree of precision, thereby reducing the manufacturing cost.

According to the aforesaid relationship between the strain ($\epsilon$) and the bending moment (M), since the strain gages 221 are attached to the strainable body 21 in this embodiment, the distance (y) from the strain gages 221 to the neutral line (X) is greater as compared with the aforesaid conventional wrench. In addition, since the second modulus of elasticity (E2) of the strainable body 21 is smaller than the first modulus of elasticity (E1) of the stem 12, and since the strainable body 21 has a moment of inertia (I) that is smaller than that of the handle 101, the strain ($\epsilon$) generated in the strain gages 221 of this embodiment is greater as compared with the aforesaid conventional wrench, thereby producing a significant change in resistance values for processing by the processing circuit 30 to obtain a precise torque value.

As shown in FIGS. 9 to 12, the second preferred embodiment of a torque-indicating wrench according to this invention is shown to be similar to that of the first preferred embodiment in construction, function and effect. Each of the gage carrying regions 213 has a recessed portion 2131 which is recessed toward the neutral line (X), and which has a receiving groove 2133 that is further recessed toward the neutral line (X). The strain gage unit 22 includes a plurality of strain gages that are integrated into a chipset 222 which is received in one of the receiving grooves 2133, and a packaging substrate 223 which is mounted on the recessed portion 2131 and which is spaced apart from the middle region 1237 of the corresponding longitudinal wall segment 1233, 1234. The packaging substrate 223 has an opening 2231 which is registered with the chipset 222, and a plurality of electrical contacts 2232 which are connected electrically to the integrated chipset 222. While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

We claim:

1. A torque-indicating wrench comprising:

a wrench body having a head which is adapted to engage and turn a workpiece about a rotational axis, and a stem which extends from said head in a longitudinal direction radial to the rotational axis, and which terminates at a coupled end, said stem being made from a material with a first modulus of elasticity, and having an inner peripheral wall to define a mounting slot, said inner peripheral wall including two longitudinal wall segments which are opposite to each other relative to a neutral line in the longitudinal direction, and front and rear transverse wall segments which are spaced apart from each other in the longitudinal direction, and which cooperate with the longitudinal wall segments to define said mounting slot, each of said longitudinal wall segments including front and rear regions which are proximate to said front and rear transverse wall segments, respectively, and a middle region which is interposed therebetween;

a handle disposed to couple with said coupled end and operable to turn said head about the rotational axis;

a strainable body made from a material with a second modulus of elasticity that is smaller than the first modulus of elasticity, and having an outer peripheral wall which is configured to be insertable into said mounting slot so as to place said strainable body in a position of use where said strainable body is subject to stretching in the longitudinal direction in response to turning movement of said handle about the rotational axis, said outer peripheral wall including a pair of front bending force transmitting areas which are opposite to each other relative to the neutral line, a pair of rear bending force transmitting areas which are opposite to each other relative to the neural line, each of said rear bending force transmitting areas being opposite to a respective one of said front bending force transmitting areas in the longitudinal direction, each of said front bending force transmitting areas and each of said rear bending force transmitting areas, in the position of use, being respectively brought into engagement with and being respectively stretchable relative to a corresponding one of said front regions and a corresponding one of said rear regions, a pair of gage carrying regions, each of which is interposed between a respective one of said front bending force transmitting areas and a respective one of said rear bending force transmitting areas, said gage carrying regions being opposite to each other relative to the neutral line, and front and rear end regions which are opposite to each other in the longitudinal direction, and which, in the position of use, are configured to be spaced apart from said front and rear transverse wall segments, respectively, so as to accommodate stretching movement of said strainable body;

a strain gage unit attached to at least one of said gage carrying regions and confronting said middle region of a corresponding one of said longitudinal wall segments to detect change in resistance values which is a function of extent of stretching deformation of said strainable body as a result of application of torque by said head when said head turns the workpiece about the rotational axis, and to translate the change in resistance values into an electrical signal;

a processing circuit connected electrically to said strain gage unit, said processing circuit calculating a value of the torque applied to the workpiece in accordance with the electrical signal from said strain gage unit so as to generate an output signal; and a display unit connected electrically to said processing circuit for receiving the output signal from said processing circuit and translating the output signal into a visual presentation.

2. The torque-indicating wrench of claim 1, wherein said gage carrying regions of said strainable body are configured such that said strain gage unit is spaced apart from said middle region so as to accommodate a deformation movement of said strainable body along a direction transverse to the longitudinal direction and the rotational axis, and brought about by the stretching deformation of said strainable body.

3. The torque-indicating wrench of claim 2, wherein said strain gage unit includes two pairs of strain gages attached to said gage carrying regions, respectively, said strain gages of each of said pairs being spaced apart from each other in the longitudinal direction.

4. The torque-indicating wrench of claim 1, wherein said handle is tubular, and has a front portion which defines a forwardly opened recess that extends in the longitudinal direction and that is configured for insertion of said stem in the longitudinal direction, and a rear portion which is opposite to said front portion for receiving said processing circuit and said display unit, and which has a display opening for displaying the visual presentation.

5. The torque-indicating wrench of claim 4, wherein said coupled end defines a wire receiving hole which extends to be communicated with said mounting slot, said at least one of said gage carrying regions defining a wire guiding hole which extends to be communicated with said wire receiving hole.

6. The torque-indicating wrench of claim 2, wherein said at least one of said gage carrying regions has a recessed portion which is recessed toward the neutral line, and which has a receiving groove that is further recessed toward the neutral line, said strain gage unit including a plurality of strain gages that are integrated into a chipset which is received in said receiving groove, and a packaging substrate which is mounted on said recessed portion and which is spaced apart from said middle region of a corresponding one of said longitudinal wall segments, said packaging substrate having an opening which is registered with said chipset, and a plurality of electrical contacts which are connected electrically to said chipset.

* * * * *